US012655594B2

(12) United States Patent
Klentzman et al.

(10) Patent No.: US 12,655,594 B2
(45) Date of Patent: Jun. 16, 2026

(54) DRIVEN PILE STABILIZATION SYSTEM AND METHODS THEREOF

(71) Applicant: URETEK USA, Inc., Tomball, TX (US)

(72) Inventors: Rex Klentzman, Austin, TX (US); Edward Hibbard, Pinehurst, TX (US); Blake Grappe, Tomball, TX (US); Derek Berthelot, Baton Rouge, LA (US)

(73) Assignee: URETEK USA, Inc., Tomball, TX (US)

( * ) Notice: Subject to any disclaimer, the term of this patent is extended or adjusted under 35 U.S.C. 154(b) by 288 days.

(21) Appl. No.: 18/327,646

(22) Filed: Jun. 1, 2023

(65) Prior Publication Data

US 2024/0159009 A1 May 16, 2024

Related U.S. Application Data

(60) Provisional application No. 63/425,150, filed on Nov. 14, 2022.

(51) Int. Cl.
*E02D 5/54* (2006.01)
*E02D 5/24* (2006.01)

(52) U.S. Cl.
CPC ..... *E02D 5/54* (2013.01); *E02D 5/24* (2013.01)

(58) Field of Classification Search
CPC ..... E02D 5/54; E02D 5/24; E02D 5/28
See application file for complete search history.

(56) References Cited

U.S. PATENT DOCUMENTS

2013/0243533 A1* 9/2013 Tarapchak ..... E02D 7/00 405/233
2014/0161540 A1* 6/2014 Barron ..... E02D 3/12 405/258.1
2016/0017562 A1* 1/2016 Barron ..... E02D 5/34 405/240

FOREIGN PATENT DOCUMENTS

KR 20090132892 A * 12/2009

* cited by examiner

*Primary Examiner* — Kyle Armstrong
(74) *Attorney, Agent, or Firm* — Norton Rose Fulbright US LLP

(57) ABSTRACT

The present disclosure includes a system and method for increasing stability of existing driven piles. In some aspects, the method includes stabilizing a foundation by positioning a first tube adjacent an H-pile that is driven into soil and injecting an expansive material through the first tube and into the soil via the first tube. In some configurations, the H-pile includes a web and a plurality of flanges extending from opposing sides of the web and the first tube is positioned between the flanges on a first side of the H-pile. Some methods may include positioning a second tube on an opposing side of the H-pile and injecting an expansive material through the second tube.

20 Claims, 8 Drawing Sheets

DRIVEN PILE STABILIZATION SYSTEM AND METHODS THEREOF

PRIORITY

This application claims the benefit of U.S. Provisional application 63/425,150 filed Nov. 14, 2022, which this application claims priority to and incorporates herein by reference in its entirety.

FIELD OF INVENTION

This disclosure relates generally, but not by way of limitation, to stabilization of piles and more particularly, to a system for increasing stability of existing H-Piles.

BACKGROUND

Large structures require a foundation to distribute the weight of the structure on the ground beneath. Foundations may extend vertically into the ground to provide stability to the structure. In scenarios in which large loads are expected, bored piers, such as steel pipe piers, can be used. When installing these bored piles, a hole is drilled and the pile is placed into the hole and compressive material is then injected into the interior of the pier to stabilize the foundation. The compressive material is injected blow the shaft to form a base or bell which increases bearing capacity and limits vertical movement of the shaft. These foundations are often referred to collectively as drilled-shaft foundations. The materials used traditionally to form these drilled-shaft foundations are concrete, steel, and cement grout. While these drilled-shaft foundations provide high axial, lateral, and moment capacity, the materials currently used, such as concrete and steel, themselves add significant weight to an already weak soil system.

Another option is to use driven piles, which are driven directly into the soil without the need for drilling a hole and filling the foundation with a compressive material. Driven piles are less expensive to install than bored piles and can only be used in certain soils (e.g., soil without rocks) in which the pile can penetrate through to the desired depth. For many design situations, bored piles offer higher capacities with potentially better economics than driven piles.

SUMMARY

The present disclosure is related to systems and methods for increasing resistance to movement for driven piles, such as H-piles. Some aspects include methods of stabilizing a foundation including positioning a first tube adjacent an H-pile that is driven into soil and injecting an expansive material through the first tube and into the soil via the first tube. The H-pile includes a webbing and a plurality of flanges extending from opposing sides of the webbing and, in some configurations, the first tube is positioned between the flanges on a first side of the H-pile. In some aspects, the method may include positioning a second tube between the flanges on a second side of the H-pile and injecting the expansive material into the soil via the second tube. After injection of the expansive material the H-pile has an increased uplift resistance.

In some configurations, the expansive material comprises a thermoset polyurethane material. The expansive material may be injected at a position that is closer to a bottom of the H-pile than a top of the H-pile. In some methods, injecting the expansive material through the first tube includes injecting the expansive material via handheld injection tool. Some methods may include identifying the H-pile from a plurality of foundational piles driven into the soil. In some such configurations, the H-pile is less resistant to movement than at least one pile of the plurality of foundational piles. Methods of the present disclosure may include identifying a second pile from the plurality of foundational piles, positioning a third tube adjacent to the second pile, and injecting the expansive material through the third tube and into the soil adjacent to the second pile. The second pile may be less resistant to movement than the at least one pile. In some configurations, the second pile is a second H-pile.

Some aspects of the present disclosure include a method of stabilizing a foundation by identifying a first set of piles from a plurality of H-piles in soil, each H-pile having a webbing and a plurality of flanges extending from opposing sides of the webbing and for each of the first set of piles, injecting an expansive material into soil between the plurality of flanges. The expansive material may a free rise density of approximately 4 lb/ft$^3$. In some configurations, identifying the first set of piles may include comparing a movement resistance to a target resistance for each pile of the plurality of H-piles and, based on the movement resistance being less than the target resistance, identifying the pile as the first set. The movement resistance may be a lateral movement resistance or a vertical movement resistance. Some methods may include positioning tubing between the flanges of each pile of the first set of piles and injecting the expansive material from the tubing. In some aspects, positioning the tubing includes driving tubing into the soil. Some methods may include cutting a top portion of the tubing after injection and leaving a bottom portion of the tubing in the soil. In some configurations, the plurality of H-piles support an existing structure.

Some methods of the present disclosure include identifying a driven pile having an uplift resistance that is less than a target resistance, driving a first tube in soil adjacent to the driven pile, and injecting an expansive material through the first tube and into the soil to contact a first side of the driven pile. Some methods may include driving a second tube in soil adjacent to the driven pile and injecting the expansive material through the second tube and into the soil to contact a second side of the driven pile. In some aspects, a cap is coupled to a distal end of the first tube during the driving step to prevent soil from entering a channel of the first tube. In some such configurations, the methods may include removing the cap from the first tube while the first tube is positioned within the soil.

Some aspects may include a system for stabilizing a driven pile including a first injection tube positioned between a pair of flanges of a driven pile on a first side and a second injection tube positioned between the pair of flanges of the driven pile on a second side. Some systems may include a first removable cap configured to be removably coupled to a distal end of the first injection tube, a second removable cap configured to be removably coupled to a distal end of the second injection tube, or both. In some configurations, the distal ends of the first and second injection tubes are driven into soil at a depth that is less than a depth of a second end of the driven pile.

The term "coupled" is defined as connected, although not necessarily directly, and not necessarily mechanically; two items that are "coupled" may be unitary with each other. The terms "a" and "an" are defined as one or more unless this disclosure explicitly requires otherwise. The term "substantially" or "approximately" is defined as largely but not necessarily wholly what is specified (and includes what is specified; e.g., substantially 90 degrees includes 90 degrees and substantially parallel includes parallel), as understood by a person of ordinary skill in the art. In any disclosed configuration, the term "substantially" may be substituted with "within [a percentage] of" what is specified, where the percentage includes 0.1, 1, 5, and 10 percent.

Further, an apparatus or system that is configured in a certain way is configured in at least that way, but it can also be configured in other ways than those specifically described.

The terms "comprise" (and any form of comprise, such as "comprises" and "comprising"), "have" (and any form of have, such as "has" and "having"), and "include" (and any form of include, such as "includes" and "including") are open-ended linking verbs. As a result, an apparatus that "comprises," "has," or "includes" one or more elements possesses those one or more elements, but is not limited to possessing only those elements. Likewise, a method that "comprises," "has," or "includes" one or more steps possesses those one or more steps, but is not limited to possessing only those one or more steps.

Any configuration of any of the apparatuses, systems, and methods can consist of or consist essentially of—rather than comprise/include/have—any of the described steps, elements, and/or features. Thus, in any of the claims, the term "consisting of" or "consisting essentially of" can be substituted for any of the open-ended linking verbs recited above, in order to change the scope of a given claim from what it would otherwise be using the open-ended linking verb.

The feature or features of one configuration may be applied to other configurations, even though not described or illustrated, unless expressly prohibited by this disclosure or the nature of the configurations.

Some details associated with the configurations described above and others are described below.

BRIEF DESCRIPTION OF THE DRAWINGS

The following drawings illustrate by way of example and not limitation. For the sake of brevity and clarity, every feature of a given structure is not always labeled in every figure in which that structure appears. Identical reference numbers do not necessarily indicate an identical structure. Rather, the same reference number may be used to indicate a similar feature or a feature with similar functionality, as may non-identical reference numbers. The figures are drawn to scale (unless otherwise noted), meaning the sizes of the depicted elements are accurate relative to each other for at least the configuration depicted in the figures.

DETAILED DESCRIPTION

Figure 1A:
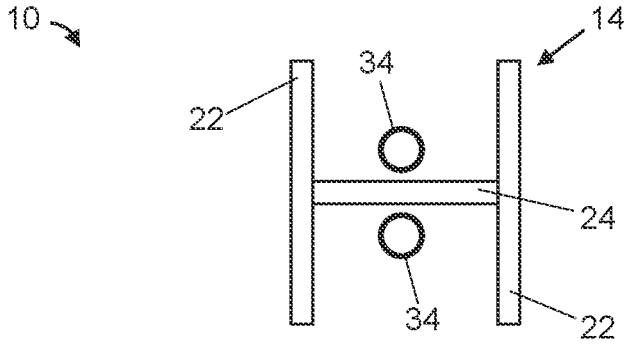
FIG. 1A is a top plan view of an example of a stabilization system according to some configurations of the present disclosure.
Figure 1B:
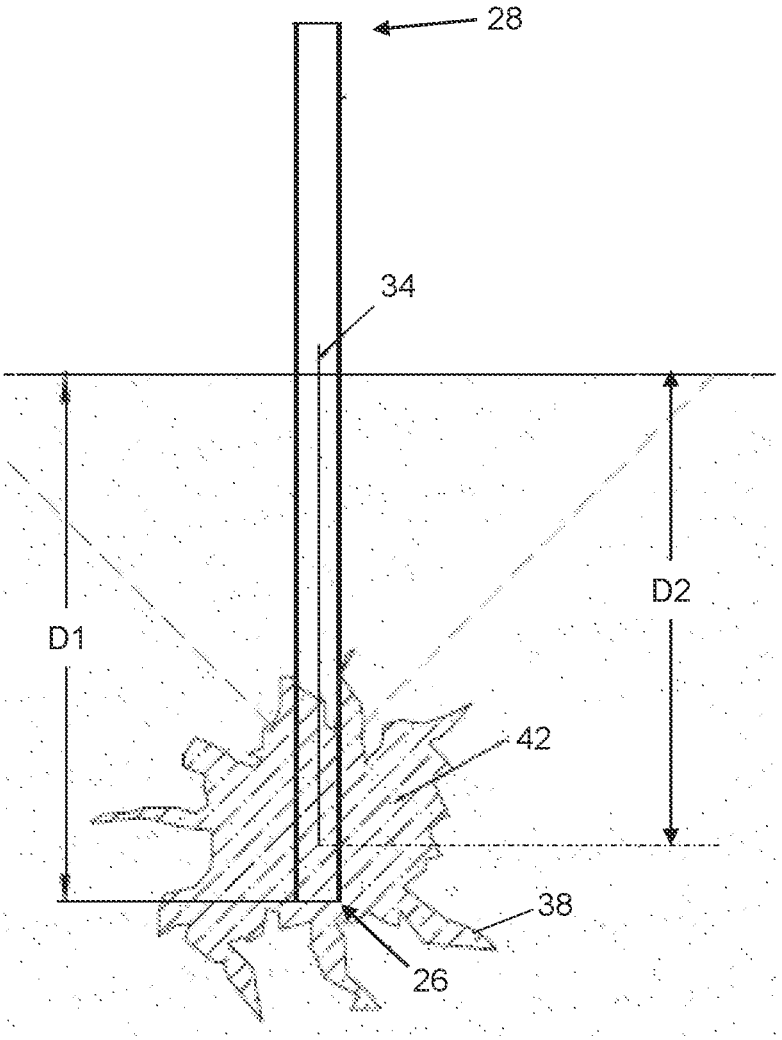
FIG. 1B is a side view of the stabilization system as shown in FIG. 1A.

Referring to FIGS. 1A-1B, a system 10 for stabilizing an pile 14 in soil 18 (e.g., ground) is shown according to configurations of the present disclosure. An example of pile 14 (e.g., H-pile) is shown in FIG. 1A and includes two flanges 22 and a web 24 extending between the flanges. Web 24 may be orthogonal to flanges 22, with the flanges extending from opposing sides of the web, to create and H-shape. System 10 may include one or more injection tubes 34 that are positionable between flanges 22 of pile 14. Pile 14 may be made of any suitable material, such as a metal, steel (e.g., galvanized steel), or other alloys. As depicted in FIG. 1A, one injection tube 34 is positioned between flanges 22 on a first side of web 24 and one other injection tube 34 is positioned between the flanges on a second side of the web. Injection tube(s) 34 are configured to inject material into soil to stabilize pile 14 as described herein. Although, the systems and methods are described with respect to H-piles, it should be understood that these system and methods could be applied to other driven piles, such as a driven pipe.

Referring to FIG. 1B, pile 14 is shown partially inserted into soil 18 such that a first end 26 is disposed within the soil and a second end 28 is outside of the soil. Pile 14 may be driven into soil 18 until a driven depth D1 is reached, as measured from first end 26 to a surface of the soil. Injection tube 34 is driven into soil 18 between flanges 22 of pile to a target depth D2. In some configurations, target depth D2 is less than depth D1 such that an end of injection tube 34 is disposed above first end of pile. In some such configurations, depth D2 may be less than 80% of depth D1, and may be equal to, less than, or between any two of: 75, 70, 65, 60, 55, 50, 45, or 40 percent a distance of depth D1 (e.g., 66% of depth D1). However, in other configurations, depth D2 may be any suitable distance as determined or calculated by the project engineer.

Once positioned at target depth D2, an expansive material 38 may be injected between flanges 22 via injection tube 34. FIG. 1B shows the injection process only for a first side of pile 14, however, it should be understood that the same process may be employed for a second side of the pile (e.g., the opposing side of web 24). As shown, expansive material 38 is injected at a position that is closer to first end 26 of pile 14 than to second end 28. Expansive material 38 is configured to increase uplift resistance of pile 14 and may include a thermoset polyurethane material or multiple materials that are associated with a thermoset polyurethane. In some configurations, expansive material 38 may have a free rise density of about 4 $lb/ft^3$. In one configuration, expansive material 38 may reach 90% of its compressive strength within one hour (e.g., within 30, 25, or 15 minutes) of injection and 100% of its compressive strength within 24 hours of injection. In some configurations, expansive material 38 may include a two-part polymer that expands to at least three times its initial liquid volume in a free-rise condition. In another configuration, expansive material 38 includes a one-part polymer that expands to at least three times its initial volume in a free-rise condition. Expansive material 38 may include a high-density polymer, such as the Uretek 486 STAR line of polymers.

As expansive material 38 is injected into soil 18, the material is configured to bind pile 14 with the surrounding soil. Expansive material 38 will adhere to pile 14 and permeate and compact the surrounding soils, with the effect of enhancing the pile's resistance to movement. For example, expansive material 38 may forms a polymer bulb 42 that connects pile 14 with soils in the vicinity of the injection point (e.g., area at target depth D2) to resist uplift of the pile. As shown, the polymer bulb 42 may expand away from pile, both vertically and laterally, depending on the soil characteristics. The depicted shape of bulb 42 is for illustration only and the actual shape may vary depending on soil conditions, such as type of material, density, existing cracks, or the like. For example, although bulb 42 is shown extending below first end 26 of pile 14 in some configurations, the polymer bulb may be disposed entirely above the first end.

FIGS. 2A-2D illustrate a method of stabilizing pile 14 that has already been driven into the ground. At FIG. 2A, injection tube 34 is shown above a surface of soil 18. Injection tube 34 is hollow (e.g., defines a channel) so that material may be injected through the tube. In FIGS. 2A-2D flanges 22 of web 24 are depicted as being transparent so that injection tube 34 can be seen when disposed between the flanges. In some configurations, injection tube 34 may have a maximum transverse dimension between 0.25 inches and 2 inches and may be made of any suitable material, such as a metal, steel, alloy, polymer, or other material. In a specific, non-limiting example, injection tube 34 may be a ⅝ inch steel injection tubing.

Figure 2A:
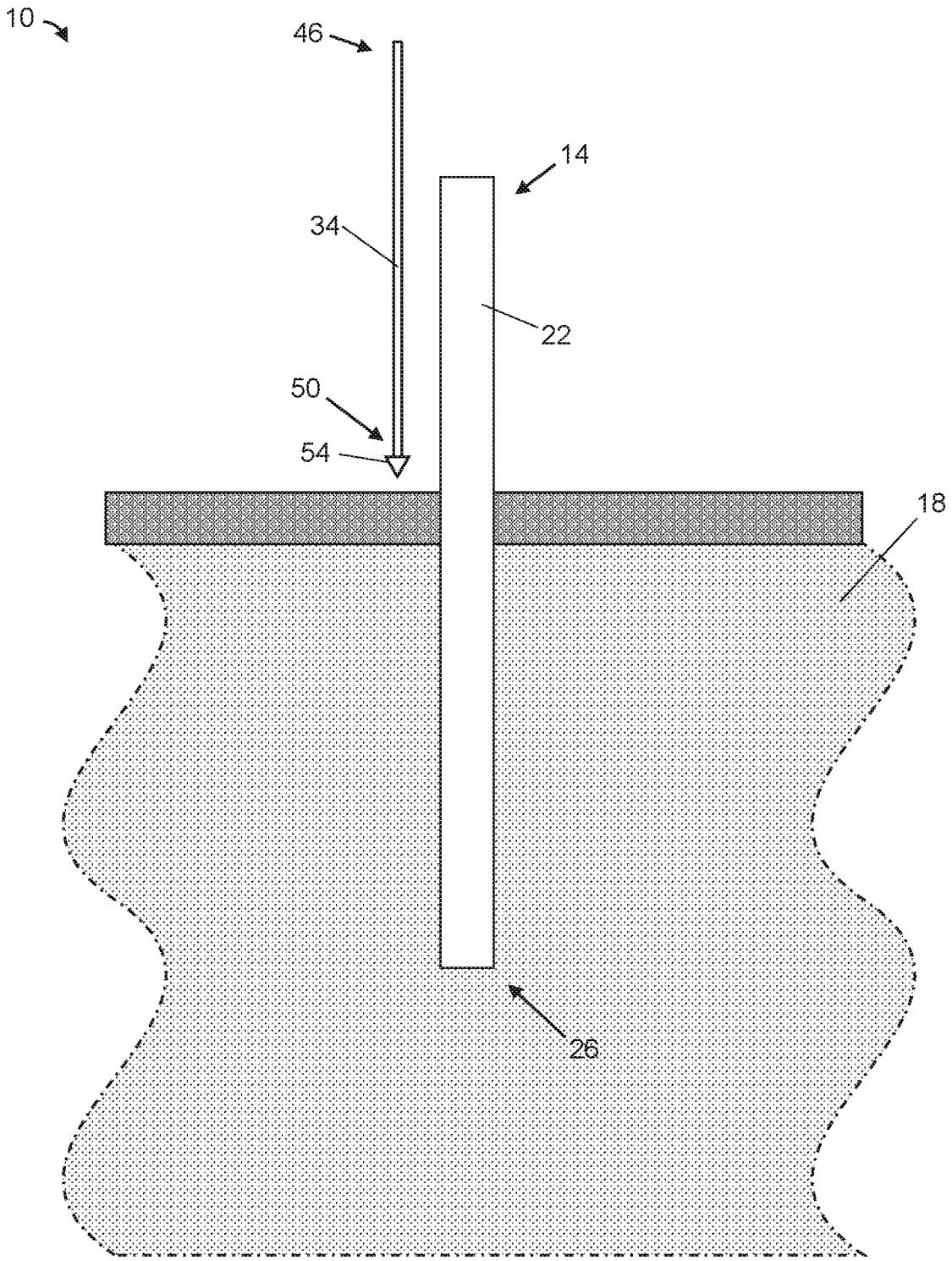
FIGS. 2A-2D show an illustrative process of using a stabilization system according to some configurations of the present disclosure.

As shown in FIGS. 2A, injection tube 34 may include a proximal end 46 and a distal end 50 that is opposite the proximal end. Distal end 50 is configured to be driven into soil 18. In some configurations, a cap 54 is coupled to distal end 50 of injection tube 34. Cap 54 may be removably coupled to injection tube 34 to allow passage of fluid from proximal end 46 to distal end 50. Removable cap 54 may prevent soil 18 from entering the channel while injection tube 34 is driven into the ground. In some configurations, cap 54 can be uncoupled from injection tube 54 by injecting material (e.g., expansive material 38) from distal end 50. In an illustrative example, cap 54 may prevent soil 18 from entering injection tube 34 in a first direction during driving of pile 14 and may be removed from the injection tube during injection of expansive material 38. In some configurations, cap 54 may be deformable and may have an opening with an unbiased transverse dimension that is less than the transverse dimension of injection tube 34 so that the cap can be stretch and coupled to the injection tube to apply a clamping force. However, in other configurations, cap 54 can be removably coupling in other suitable manners as known in the art.

Figure 2B:
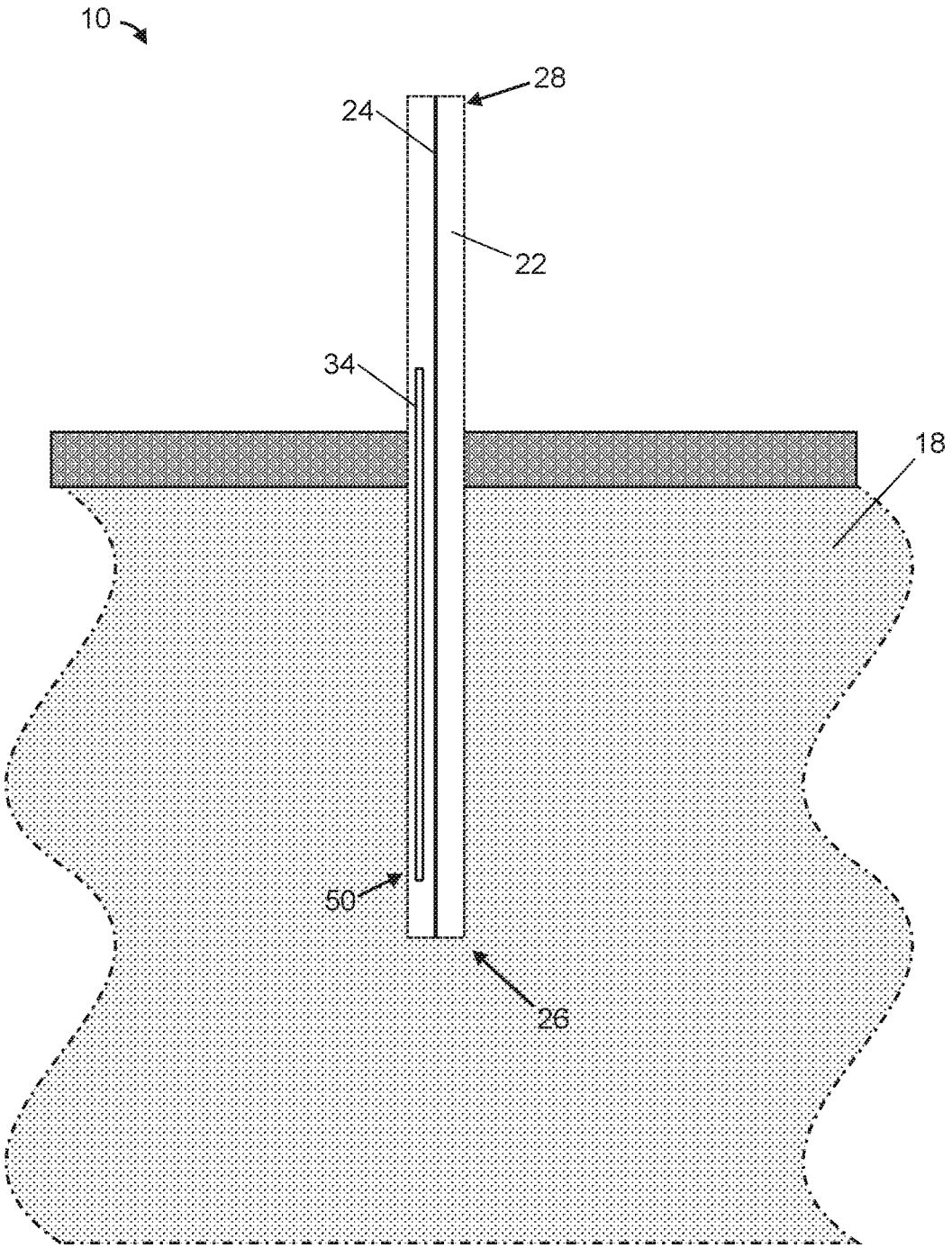

Referring to FIG. 2B, injection tube 34 is positioned adjacent to a first side of web 24 and driven into soil 18. In some configurations, injection tube 34 is disposed directly between flanges 22 of pile 14. In some such configurations, distal end 50 of injection tube 34 is in close proximity to the pile such that expansive material 38 ejected from the distal end contacts a portion of the pile. Injection tube 34 may be driven into soil 18 in any suitable manner. In an illustrative, non-limiting example, injection tube 34 may be driven into place using a hand held hammer drill. In other configurations, injection tube 34 may be driven by hand (e.g., via a mallet) or other equipment. Once injection tube 34 is positioned in soil 18, proximal end 46 of the injection tube is accessible via an operator. To illustrate, one or more fittings, tubing, couplings, connectors, or other equipment may be connected to proximal end 46 of injection tube 34.

Figure 2C:
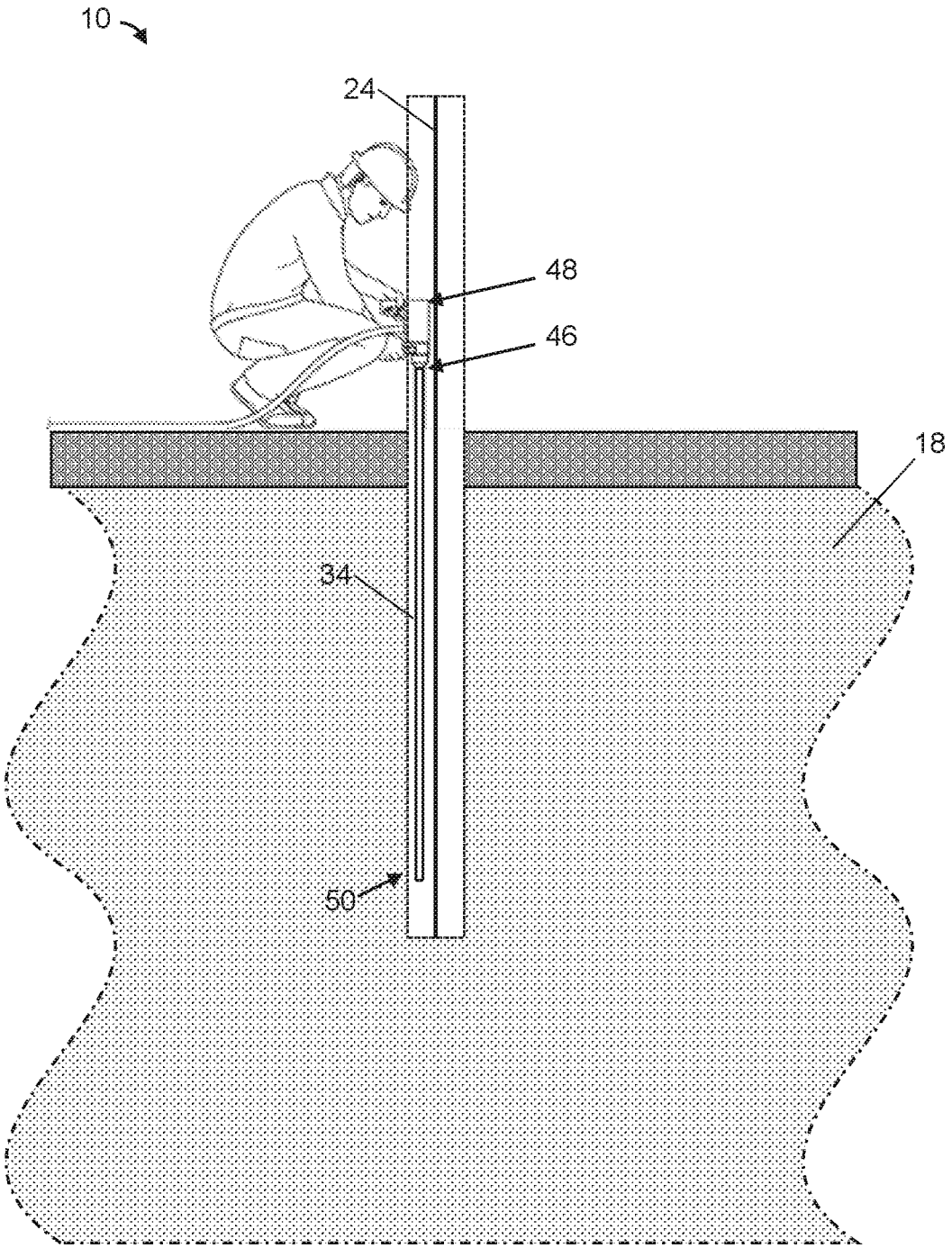

Referring now to FIG. 2C, a handheld injection gun 48 is coupled to proximal end 46 of injection tube 34 such that the injection gun is in fluid communication with the injection tube. Tubing may couple the injection gun 48 to a fluid reservoir (not shown) that may be filled with expansive material. In some configurations, fluid reservoir may be disposed in a portable production rig (e.g., truck) and at least one tube may fluidly connect the reservoir to a respective injection gun (e.g., 48). In such configurations, additional equipment, such as pressure sources (e.g., pumps, compressors, pressurized tanks, or the like) may be included on the production rig to assist in delivering expansive material 38 to injection tube 34. In other configurations, expansive material 38 may be delivered to injection tube 34 via other methods, as understood in the art.

A determined quantity of expansive material 38 is delivered to soil 18 via injection tube 34. The amount of expansive material 38 may be calculated based on soil characteristics (e.g., soil type, soil stiffness, moisture content, and other conditions), pile data (e.g., movement resistance of pile), or the like. In another configuration, other equipment may be used to determine the injection amount, such as a pressure senor, force gauge, or pressure monitoring device. Injection tube 34 may remain in place during the injection and is not required to move vertically during the injection of expansive material 38. This operation may help in keeping the soil 18 compact near pile 14.

In some configurations, the amount of expansive material 38 injected may be measured by an operator and, in other configurations, the amount of injected material may be determined by a computing system. For example, the control system may receive an input (e.g., from a user, as a signal from another device, or the like) and dispense a determined amount of material based on the input. The control system may be any suitable control system and may include a processor (e.g., microcontroller/microprocessor, a central processing unit (CPU), a field-programmable gate array (FPGA) device, an application-specific integrated circuits (ASIC), another hardware device, a firmware device, or any combination thereof) coupled to a memory (e.g., a non-transitory computer-readable storage medium, volatile memory devices, such as random access memory (RAM) devices, nonvolatile memory devices, such as read only memory (ROM) devices, programmable read-only memory, and flash memory, or both).

Once injected, expansive material 38 may expand outward in lateral direction. In some configurations, expansive material 38 may be delivered to soil 18 via an opening at distal end 50 of injection tube 34. However, in other configurations, such as where cap 54 is permanently affixed to injection tube 34, the injection tube may define one or more slits near distal end 50 (e.g., within sidewall) to dispense expansive material 38. In some such configurations, slits may extend circumferentially around the sidewall of injection tube 34. In yet other configurations, expansive material 38 may be injected from injection tube 34 in other known means in the art. As expansive material 38 expands within soil 18 it may adhere to both the soil and pile 14 as well as other impediments (e.g., rocks) within the soil. This material may permeate through soil 18 to create a web or bulb 42 of expansive material that limits the movement of pile 14. As shown, bulb 42 may have a plurality of branches that extend in different directions. These branches may help anchor pile 14 into place and, in some configurations, may even reach to other piles (e.g., 14) and associated branches to help create a network of expansive material.

Figure 2D:
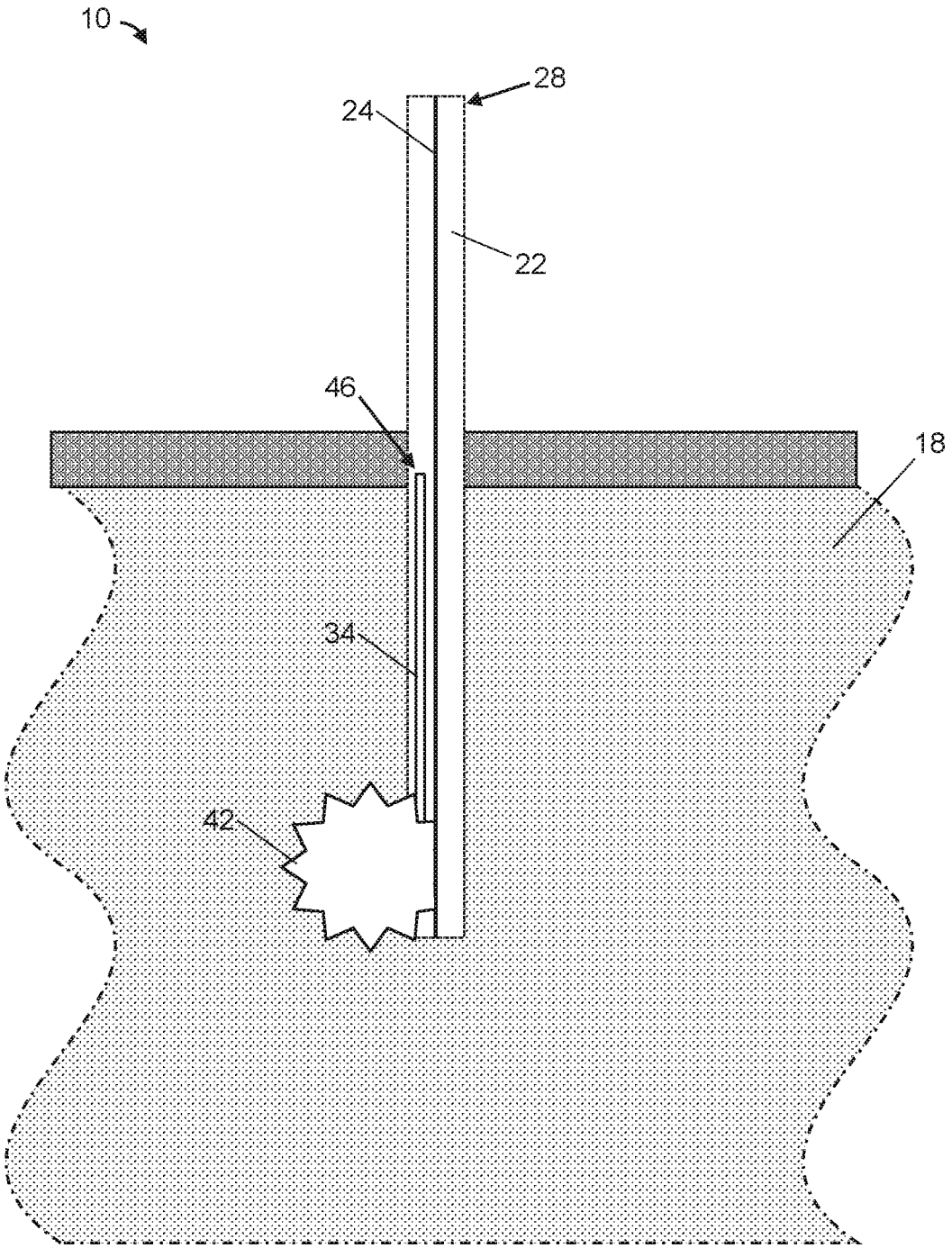

In some configurations, after the quantity of expansive material 38 is delivered to soil 18, injection tube 34 may be left in the soil. As shown in FIG. 2D, a portion of proximal end 46 of injection tube 34 may be cut. As an illustrative example, injection tube 34 may be cut so that proximal end 46 of the injection tube is below ground level (e.g., 2-12 inches below ground level). This may increase safety of the area and prevent injection tube 34 from becoming a tripping hazard.

Figure 3A:
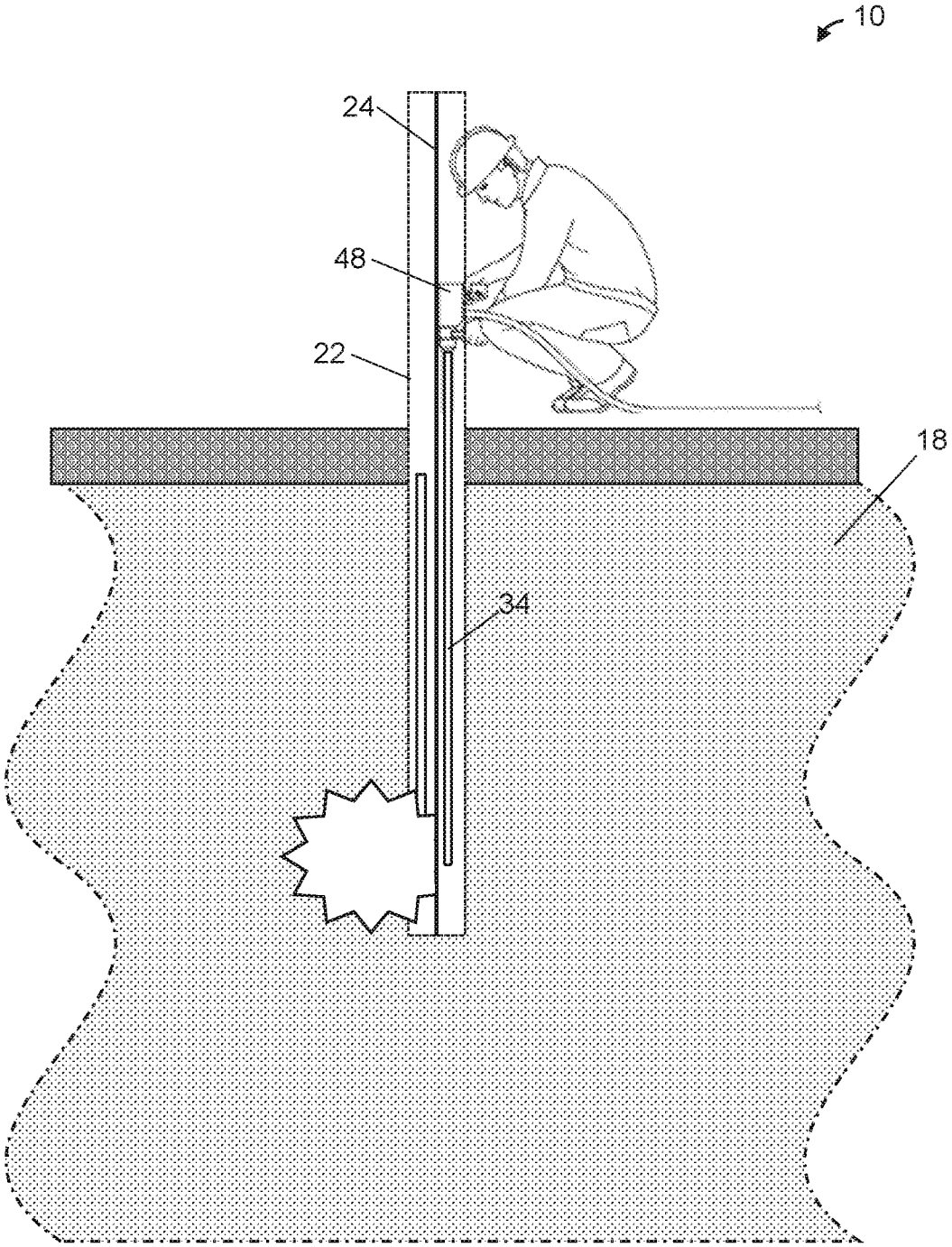
FIGS. 3A-3B show an illustrative process of using a stabilization system according to some configurations of the present disclosure.
Figure 3B:
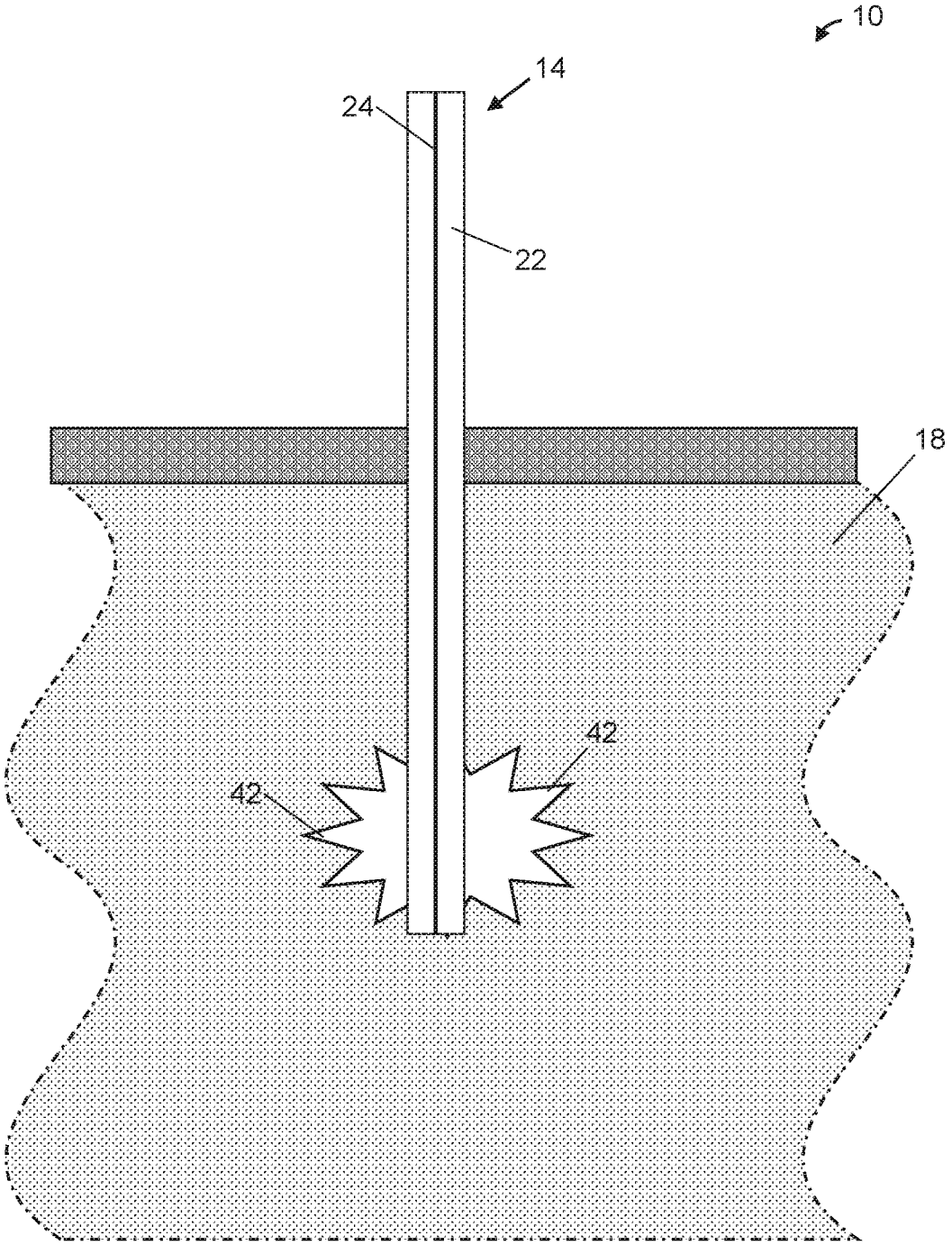

Referring now to FIGS. 3A and 3B, this process may be repeated on the second side of pile 14. For example, FIG. 3A shown another injection tube 34 disposed between flanges 22 of pile 14 on a second side of web 24. Injection tube 34 on second side of pile 14 may be the same as that on the first side of the pile or may be different. For example, one of the injection tubes (e.g., 34) may be driven to a different depth based on measurements or other determinations as described herein. Following the steps described above with respect to FIGS. 2A-2D, expansive material 38 may be injected on the second side of pile to form a second bulb 42. The expansive material 38 from the first and second sides of pile 14 may contact one another to create a single bulb (e.g., 42) that is adhered to both sides of the pile and the surrounding soil 18. This may increase the movement resistance of pile 14 to all lateral movement (e.g., in a 360 degree range) as well as increase the vertical movement resistance.

Figure 4A:
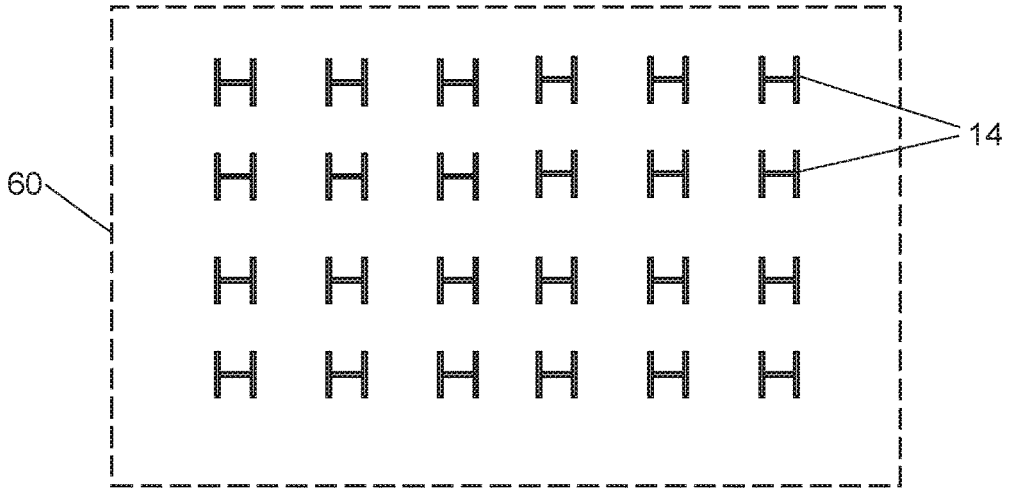
FIG. 4A is a top plan view of an example of a foundation having a plurality of H-piles.

Referring now to FIG. 4A, shown is a plot 60 having a plurality of H-piles 14 driven thereon. The piles 14 may be associated with a foundation of a single structure or a plurality of separate structures. Although piles 14 are arranged in a rectangular grid, it should be understood that the systems and methods described herein would apply to other arrangements. In some configurations, one or more of piles 14 may be subjected to testing to determine if an increase in stability is warranted. In some examples, each pile 14 may be tested and, in other examples, only one pile (e.g., 14) of a subset of piles are tested for a certain geography region.

Figure 4B:
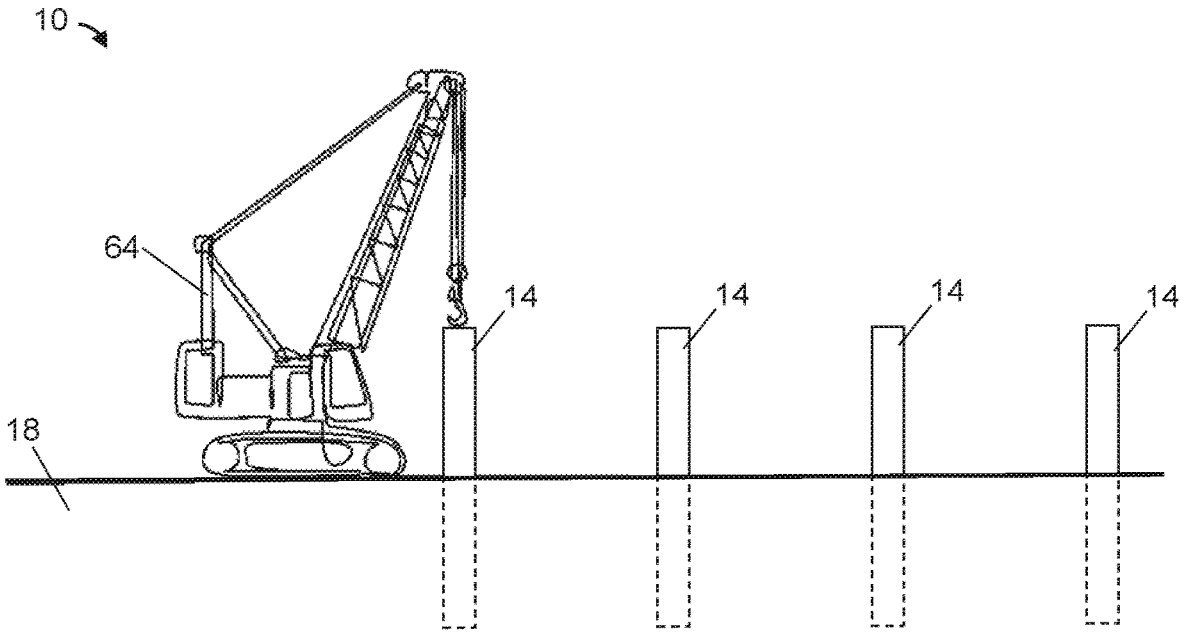
FIG. 4B show an illustrative process of identifying H-piles in need of stabilization according to some configurations of the present disclosure.

As shown in FIG. 4B, a machine 64 (e.g., a crane, hydraulic jack, slide system, forklift, wench, towing system, or the like) may be used to apply a force to pile 14. For example, machine 64 may apply a vertical force to pile 14 to measure vertical displacement of the pile. Machine 64 and pile may be coupled together in any suitable manner, such as via hooks, straps, or other fasteners. In some configurations, a movement resistance of pile 14 may be determined and used to identify whether a pile should be treated. As a specific non-limiting example, a pile 14 may be identified as a pile to be treated based on a movement resistance of the pile being less than a target resistance. In some methods, a subset of piles 14 may be chosen or identified based on the piles resistance to movement and stabilization treatment performed on the subset of piles. For example, piles having a movement resistance (e.g., lateral or vertical movement resistance) less than a target resistance may be identified as the subset of piles.

In some configurations, a load cell may be disposed between the machine 64 and pile 14 to determine a vertical force acting on the pile. Additionally, or alternatively, one or more gauges (e.g., displacement gauge or sensor) or measurement devices may be used to calculate a displacement of pile 14. In some configurations, the amount of force before displacement, total displacement, amount of displacement below a target force, or other criteria may be used to determine if a respective pile 14 needs to be treated.

The above specification and examples provide a complete description of the structure and use of illustrative configurations. Although certain configurations have been described above with a certain degree of particularity, or with reference to one or more individual configurations, those skilled in the art could make numerous alterations to the disclosed configurations without departing from the scope of this invention. As such, the various illustrative configurations of the methods and systems are not intended to be limited to the particular forms disclosed. Rather, they include all modifications and alternatives falling within the scope of the claims, and configurations other than the one shown may include some or all of the features of the depicted configurations. For example, elements may be omitted or combined as a unitary structure, connections may be substituted, or both. Further, where appropriate, aspects of any of the examples described above may be combined with aspects of any of the other examples described to form further examples having comparable or different properties and/or functions, and addressing the same or different problems. Similarly, it will be understood that the benefits and advantages described above may relate to one configuration or may relate to several configurations. Accordingly, no single implementation described herein should be construed as limiting and implementations of the disclosure may be suitably combined without departing from the teachings of the disclosure.

The previous description of the disclosed implementations is provided to enable a person skilled in the art to make or use the disclosed implementations. Various modifications to these implementations will be readily apparent to those skilled in the art, and the principles defined herein may be applied to other implementations without departing from the scope of the disclosure. Thus, the present disclosure is not intended to be limited to the implementations shown herein but is to be accorded the widest scope possible consistent with the principles and novel features as defined by the following claims. The claims are not intended to include, and should not be interpreted to include, means-plus- or step-plus-function limitations, unless such a limitation is explicitly recited in a given claim using the phrase(s) "means for" or "step for," respectively.

The invention claimed is:

1. A method of stabilizing a foundation, the method including:

applying a target force to at least one H-pile from a population of H-piles, each H-pile having a web and a plurality of flanges extending from opposing sides of the web;

determining an amount of displacement of the at least one H-pile at the target force;

comparing the displacement of the at least one H-pile to a minimum displacement threshold;

based on the displacement exceeding the minimum displacement threshold, identifying a first set of piles from the population of H-piles; and for the first set of piles, injecting an expansive material into soil to contact the web of the H-pile.

2. The method of claim 1, further comprising:

driving a first tube into soil adjacent to the at least one H-pile and injecting the expansive material into the soil via the first tube; and driving a second tube between the flanges on a second side of the at least one H-pile and injecting the expansive material into the soil via the second tube.

3. The method of claim 1, wherein the expansive material comprises a thermoset polyurethane material.

4. The method of claim 1, wherein, for the first set of piles, the expansive material is injected at a position that is closer to a bottom of the H-pile than a top of the H-pile.

5. The method of claim 1, wherein injecting the expansive material includes injecting the expansive material via hand-held injection tool.

6. The method of claim 1, wherein after injection of the expansive material the first set of piles has an increased uplift resistance.

7. The method of claim 1, further comprising identifying a second set of piles that do not need to be treated.

8. The method of claim 7, wherein:

the first set of piles includes the at least one H-pile and a second pile from the population of H-piles;

positioning a third tube adjacent to the second pile; and injecting the expansive material through the third tube and into the soil adjacent to the second pile.

9. The method of claim 1, wherein the target force is not applied to at least a subset of the first set of piles.

10. The method of claim 8, wherein the second pile is a second H-pile.

11. A method of stabilizing a foundation, the method including:

applying, via a machine, a first force to one or more piles from a population of H-piles in soil, each H-pile having a web and a plurality of flanges extending from opposing sides of the web;

determining a movement resistance of the one or more piles while the first force is applied;

based on the movement resistance being less than a target resistance, identifying a first set of piles from a population of H-piles; and for each pile of the first set of piles, injecting an expansive material into soil between the plurality of flanges.

12. The method of claim 11, wherein the first set of piles includes the one or more piles upon which the first force was applied and one or more other piles in the same geographic region as the one or more piles.

13. The method of claim 12, wherein:

the movement resistance is lateral movement resistance; and the first set of piles includes two or more piles from the population of H-piles and the first set of piles is less than the population of H-piles.

14. The method of claim 11, further comprising driving tubing into the soil between the flanges of each pile of the first set of piles and injecting the expansive material from the tubing.

15. The method of claim 14, further comprising, after injection, cutting a top portion of the tubing and leaving a bottom portion of the tubing in the soil.

16. The method of claim 11, wherein the expansive material has a free rise density of approximately 4 $lb/ft^3$.

17. A method of stabilizing a foundation, the method including:

for a first H-pile of a subset of H-piles that is determined to have an uplift resistance that is less than a target resistance as measured via a machine applying a force to one or more H-piles of the subset of H-piles, driving a first tube in soil adjacent to the first H-pile; and injecting an expansive material through the first tube and into the soil to contact a first side of the first H-pile.

18. The method of claim 17, comprising:

driving a second tube in soil adjacent to the first H-pile; and injecting the expansive material through the second tube and into the soil to contact a second side of the first H-pile.

19. The method of claim 17, further comprising injecting the expansive material into the soil to contact a second H-pile of the subset of H-piles, and wherein the second H-pile and first H-pile are in the same geographic region.

20. The method of claim 17, wherein applying the force to one or more H-piles includes applying the force to the first H-pile.

* * * * *